United States Patent [19]

Goldberg

[11] 4,351,898

[45] Sep. 28, 1982

[54] MIXED GRAIN SINGLE EMULSION LAYER PHOTOGRAPHIC MATERIAL

[76] Inventor: Richard J. Goldberg, 4814 Brandenburg Pl., Tarzana, Calif. 91356

[21] Appl. No.: 866,272

[22] Filed: Jan. 3, 1978

[51] Int. Cl.[3] ..... G03C 1/08; G03C 1/34

[52] U.S. Cl. ..... 430/571; 430/470; 430/542; 430/598

[58] Field of Search ..... 96/19, 121, 98, 66.3, 96/95; 430/544, 551, 571, 598

[56] References Cited

U.S. PATENT DOCUMENTS

| | | | |
|---|---|---|---|
| 2,388,859 | 11/1945 | Mannes et al. | 96/121 |
| 2,490,749 | 12/1949 | Fierke et al. | 96/98 |
| 2,496,940 | 2/1950 | Hanson et al. | 96/121 |
| 2,614,925 | 10/1952 | Carroll et al. | 96/19 |
| 2,673,149 | 3/1954 | Carroll | 96/121 |
| 3,958,993 | 5/1976 | Fujiwhara et al. | 96/66.3 |

OTHER PUBLICATIONS

Newmiller, et al.: Photographic Science and Engr. vol. 5, No. 5, Sep.-Oct., 1961, pp. 283-287.

*Primary Examiner*—Richard D. Lovering
*Attorney, Agent, or Firm*—Fulwider, Patton, Rieber, Lee & Utecht

[57] ABSTRACT

A single emulsion layer photographic material such as a film or print material composed of a mixture of separate silver halide grains that are separately responsive to different colors of light and thereafter are treated to provide a colored image of the subject.

3 Claims, No Drawings

MIXED GRAIN SINGLE EMULSION LAYER PHOTOGRAPHIC MATERIAL

BACKGROUND OF THE INVENTION

It has long been an object of workers in the photographic field to provide a light sensitive material that would provide a colored image of a subject with the colors of the image corresponding to the colors of the subject. Because of the nature of the photographic process and the fact that in most instances a negative image is first formed and then a positive image, a negative color image will not have the same colors and the same areas as the subject but there will be corresponding colors in the same areas. Thus, a negative color image of a red flower with green folliage against a blue sky will show a cyan flower with magenta folliage against a yellow sky. A negative may thus be said to have corresponding colors, though not identical colors.

In the early days of color photography color photographs were made by exposing three separate negatives through three separate filters to provide three separate negatives for the three separate color images. These black and white negatives were then printed to form three separate positives and the separate color value positives were then separately toned, placed in register and the color reproduction of the original subject was produced.

Later, the process was modified to use a multi-color filter in front of a single sheet of negative material, the multi-colored filter being provided by a layer of dyed starch grains or a geometric arrangement of dyed gelatin pieces. These processes require that the silver image either be held immovable with respect to the filter, as with the randomly arranged dyed starch grains, or that the image be aligned with the proper corresponding geometrical pattern of the gelatin filter.

More recently, color photography has relied upon color films that incorporate a plurality of emulsions on a single base with the emulsions being separately sensitized to different wave lengths of light and being treated in the processing so that the emulsions develop colors corresponding to the image of the subject matter. In these processes, all the emulsions are generally simultaneously subjected to the same treatment and the different colors are developed by reason of the differences within the separate emulsions.

Many attempts have been made to produce a single emulsion color film in which the three different colors are produced within a single emulsion layer. Because of the different chemistry necessary to produce the different colors, this has been a difficult problem and has not previously been done on a commercial scale. The advantages of a single emulsion as opposed to a triple emulsion with intermediate separation layers include the advantages of a thinner film and its attendant advantages of superior resolution and greater definition. Furthermore, with the thinner emulsion or series of emulsions, the photographic processing can proceed more readily without the various treatment chemicals being required to penetrate through so much material to react with all of the photochemicals.

SUMMARY OF THE INVENTION

The present invention relates to a photographic material, either transparency or non-transparency, having a single layer of emulsion provided with mixed grains that are separately sensitized to react differently to light. This difference may be a difference in the speed or sensitivity of the grains, so that a single emulsion may have both high and low speeds, i.e., an extended range of sensitivity to the intensity of light, useful in monochromatic photography where the brightness of the areas of the subject may vary over a wide range. The difference may be a difference in sensitivity to colors, so that some grains are sensitive, for example, to red, some to green, and some to blue, and these grains are separately treated to provide the separate colors necessary. The grains are treated separately from the grains of different sensitivities by what may be termed barriers that prevent the chemicals intended for grains of one sensitivity from acting upon the grains of a different sensitivity. In one form of emulsion, the grains sensitive to one color are not provided with any barrier at all and thus these grains may be developed easily by a standard developer. The grains responsive to a second color are provided with a barrier that prevents the first developer from affecting them but a more powerful developer will affect them but not grains that are provided with a still greater amount of barrier. The first grains that were provided with no barrier at all are not affected by the second developer since the first grains have already been developed or removed. A third developer, more powerful than the second, overcomes the second barrier and develops the third set of grains. The first and second sets have already been developed or removed and hence are unaffected by the third developer.

DESCRIPTION OF EMULSION AND ITS PREPARATION

To prepare the mixed grain emulsion, three separate emulsion components are made up. These components are prepared from two separate sub-emulsions, one designated a chloride emulsion and the other designated a bromide emulsion.

| CHLORIDE EMULSION | | |
|---|---|---|
| | Water | 150 ml |
| | KBr | 3.8 g |
| I | $NH_4Cl$ | 6.7 g |
| | "Sulfur" | ¼ ml |
| | Gelatin | 6.0 g |
| | Water | 150 ml |
| II | $AgNO_3$ | 20 g |
| | Gelatin | 2.0 g |

Gelatin used in parts I and II is of a quality suitable for photographic use, such as that manufactured by Rousselot (France) Lot #18-925.

The "Sulfur" is made by dissolving 250 mg of sodium thiosulfate in water and diluting to 250 ml. This provides a concentration of 1 mg per ml and enables ready measurement without employing micro balance equipment.

Procedure

The gelatin in Part I was mixed with 100 ml of water at room temperature and allowed to swell for half an hour. The reaction vessel was heated in a hot water bath to bring the solution to 48.8° C. and dissolve the gelatin. In a separate container the bromide and chloride salts were dissolved in 50 ml distilled water, warmed to 37.7° C. prior to addition, and charged with a dropping funnel set to deliver the total volume of 53 ml in 70 seconds.

The gelatin and water of Part II were mixed together and allowed to stand for half an hour to permit swelling of the gelatin. Heat was applied to dissolve the gelatin, then in light from a red (1A) safe-light the crystalline silver nitrate was dissolved. The final temperature was adjusted to 43.3° C., and the solution charged into a dropping funnel programmed to deliver the total volume of 156 ml in 100 seconds.

The temperature of the reaction vessel containing Part I, water and gelatin, was heated to 51.1° C. A suitable mixer was arranged to give excellent agitation. Tubes from the two dropping funnels were arranged to bring the salts and silver into the solution below its surface and in close proximity to each other.

The simultaneous addition of salts and silver nitrate gelatin was begun by allowing the salts to flow 5 seconds before beginning the addition of silver nitrate. During the additions heat was applied and the internal temperature was maintained at 51.1° C. Heating at the end of the addition time brought the temperature to 51.6° C. Digestion was allowed to proceed for 5 minutes.

The temperature was reduced to 32.2° C. by external cooling water sprayed on the outside of the pot.

When the internal solution temperature had been lowered to 32.2° C. the silver halide gelatin was coagulated by addition of 31.4 grams of crystalline ammonium sulfate. The coagulant, fluffy in nature, settled slowly to the bottom of the vessel. Cooling water was continually sprayed on the outside of the vessel to lower the internal temperature of the solution and precipitate to 20.5° C.

In about half an hour the precipitate of AgX-gelatin had settled to the bottom of the vessel so that the supernatant liquid could be removed by drawing it off through an aspirator.

The white precipitate was washed by successive applications of 500 ml each 4.4° C. water—stirring several minutes—then, each time, allowing the precipitate to settle and decanting the supernatant fluid. Ten such cycles were required to remove the soluble salts.

The washed coagulum was reconstituted by stirring into the slurry 200 grams of 10% gelatin melted at 37.7° C. Heat with stirring was continued for one hour at 43.3° C. At the end of this time the temperature was raised to 48.8° C.

Heat with stirring was continued for (after ripening) sixty minutes. The final emulsion was treated with 10 ml of chloromethyl phenol (10% in methanol) to prevent bacterial invasion. The emsulion was cooled to 15.5° C., then stored at 4.4° C. in darkness prior to being used in color coatings. The resulting emulsion had a volume of 550 ml, 5% gelatin.

| BROMIDE EMULSION | | | |
|---|---|---|---|
| I | Water | 200 ml | |
| | KBr | 28.9 | at 54.4° C. |
| | $NH_4Cl$ | 7.49 g | |
| | Gelatin | 12.0 g | |
| II | Water | 250 ml | |
| | $AgNO_3$ | 48.5 g | at 51.6° C. |

Gelatin = Rousselot Lot #18-925

Part I

Water and gelatin were stirred together at room temperature for 30 minutes to allow the gelatin to swell. The salts were added and temperature raised to 54.4° C. in a hot water bath. The resulting solution was treated by a suitable mixer adjusted to give excellent agitation.

Part II

Silver nitrate solution was made as shown above and its temperature was adjusted to 51.6° C. The total volume was charged into a dropping funnel which was adjusted to deliver the fluid in 7 minutes time.

The silver nitrate was added to the gelatin salts with stirring over a period of seven minutes. The emulsion temperature was held at 54.4° C. for 10 minutes following the silver addition. At the end of this period the temperature of the emulsion was reduced to 32.2° C. by external spray. This cooling required about 3 minutes. Then the emulsion was coagulated by addition of 4 grams of ammonium sulfate crystals. The temperature of the stirring mass was reduced by external spraying to 10° C. Stirring was stopped and the coagulum allowed to settle to the bottom of the vessel. The supernatant fluid was removed by suction and the precipitate of AgX-gelatin particles was washed by ten successive 400 ml portions of cold water at 4.4° C., each time drawing off the supernatant fluid.

The slurry, or precipitate with supernatant liquid removed to minimum volume, was reconstituted by adding melted 10% gelatin at 37.7° C. (250 grams total), and bringing the temperature to 43.3° C. The emulsion was stirred at 43.3° C. for one hour, then the temperature was raised to 60° C. Stirring was continued at 60° C. for 20 minutes. After this after-ripening process was completed the temperature was reduced to 37.7° C. and 2½ ml of chloromethyl phenol (10% methanol) was added. The emulsion was treated by addition of 180 ml of 8.0 g/l barrier (pH 8.0) in dilute sodium hydroxide. The emulsion was stirred as it cooled to 15.5° C. and then stored at 4.4° C. in darkness prior to being used in color coatings.

As previously indicated, the present invention makes use of what may be termed barriers or antifoggants and a discussion of these products and their chemical structure is to be found in "SPSE Handbook of Photographic Science and Engineering", edited by Thomas, copyright 1973, on pages 548 and 549. It is to be understood, of course, that the particular antifoggant or barrier that is used is relatively immaterial so long as the desired effect of separating the different emulsion components is secured. Thus, while very satisfactory results have been obtained with the compound 1-phenyl-5-mercaptoterazole, this is not to suggest that this is the only satisfactory barrier for the present purposes.

For the purposes of this invention, a barrier may be broadly defined as any compound that can properly be put into a photographic emulsion to inhibit development. The theory of the photographic process indicates that in order for photographic development to proceed, there must be both metallic silver and silver ions present for the developer to act. The barrier used in the present invention interferes with the availability of both the metallic silver and silver ions by the barrier's being adsorbed to them to prevent the action of the developer. The barrier may thus be thought to block either the metallic silver or the silver ions or both. A product that tends to decrease the concentration of metallic silver, or free silver ions, or both, that is available to the developer, is able to inhibit development and thus is a barrier. Expressed differently, the product must be hydrophilic as to silver halide (argento-philic) and hydrophobic as to developer. In general, the particular barrier used is less important than the fact that different amounts of barrier, producing the different development barriers, are used. The amount of barrier required to produce a given result will also vary with the crystal structure and composition of the silver halide.

Preparation of Emulsion Components

A mixed grain emulsion formed of three components and applied as a single layer can be made as a negative film, a reversal film, or as an emulsion for a print. The negative film consisting of a mixed grain emulsion mounted on a transparent base is treated as hereinafter described to provide a negative image in which a yellow image is formed in the region exposed to blue light, a magenta image is formed in the region exposed to green light, and a cyan image is formed in the region exposed to red light.

The preparation of the multi-grain emulsion required the preparation of three emulsion components. Emulsion component no. 1 was prepared by melting 30 grams of the chloride emulsion previously described, incubating it at 29.5° C. and sensitizing it by the addition of 5 ml of methanol solution of green sensitizing dye 4560 at a concentration of 1 to 3,000. The chemical formula of green sensitizing dye is:

5-[(3-ethyl-1-(2)-napthoxazolylidene)ethylidene]-3-allyl-1-phenyl-2-thiohydantoin Emulsion component no. 1 was held at 29.5° C. while the other two emulsion components were prepared.

Emulsion component no. 2 was prepared by melting and incubating 35 grams of the previously described chloride emulsion at 29.5° C. and then sensitizing that emulsion to red light by the addition of 7 ml of a methanol solution of a sensitizing dye R-4 having a concentration of 1 to 4,000. Sensitizing dye R-4 has the chemical composition:

3,3'-Diethyl-9,11-neopentylene-2,2'-thiodicarbocyanine iodide.

The resulting red sensitive emulsion was incubated at 29.5° C. for several minutes before the addition of 3 ml of an alkaline aqueous solution of barrier having a concentration of 8 grams per liter and a pH of 8.0. The resulting barrier containing emulsion component no. 2 was held at 29.5° C. while emulsion component no. 3 was prepared.

Emulsion component no. 3 makes use of 25 grams of the previously described silver bromide solution that is melted at 29.5° C. to which there is added 6 ml of the alkaline aqueous solution of barrier having a concentration of 8 grams per liter and having a pH of 8.0. While the emulsion component is incubated and maintained at 29.5° C. it is stirred to provide thorough mixing of the barrier and emulsion and thereafter this component no. 3 is diluted by the addition of emulsion component no. 2 and the two are thoroughly stirred for several minutes to ensure complete and intimate mixture of emulsion components nos. 2 and 3. Thereafter, emulsion component no. 1, likewise maintained at 29.5° C., is added to the mixture of components nos. 2 and 3 and again the mixture is thoroughly stirred to provide complete mixing. Incubation or aging of the mixture continued at 29.5° C.

From the foregoing it will be recognized that emulsion component no. 1, containing the green sensitizing dye, will be responsive to green light; emulsion component no. 2, containing the red sensitizing dye, will be responsive to red light; and emulsion component no. 3 will be responsive to blue light.

A laboratory sample of film making use of the mixed grain emulsion just described, has been made, it being understood that the procedure herein described is by way of example only and will not be followed in normal production.

Prior to the coating operation, 5 ml of 10% aqueous detergent solution (sodium lauryl sulfate) was added to the mixed grain emulsion. The emulsion was flowed through a vertical slot approximately 10 centimeters wide at a rate of 45 ml per minute onto a 10 centimeter wide polyester subbed film travelling at a speed of approximately 3.5 centimeters per second. The web moved into a chilled zone of approximately −4.4° C. to 0° C. and then into a drying section maintained at 18.3° C., where it stayed for approximately 2 minutes. Thereafter, the drying of the set emulsion was continued by moving the web spirally through warm air between 32.2° C. and 37.7° C. for 5 minutes and thereafter reconditioning the coating at room temperature prior to winding.

It should be noted that, as customary, all operations were performed under light conditions having due regard to the sensitivity of the emulsion components. Those components that had not yet been sensitized by the sensitizing dyes were weighed and prepared under red safelight and after the emulsion components had been sensitized, subsequent operations had to be performed under dim amber safelight, sometimes identified as Series 10 safelight. This latter safelight allowed only minimial vision for the operators but protected the sensitized emulsions from all wavelengths of light, save a minor transmission at about 600 millimicrons.

By way of example only and not as a limitation, the resulting mixed grain emulsion prepared in the manner just described has a final thickness of something less than 15 microns.

Processing of Mixed Grain Emulsion

After the exposure of the emulsion, it is then treated in a series of steps in such a manner that the most easily developed grains or emulsion component is first developed, thereafter the emulsion component containing the lesser amount of barrier is developed and, lastly, the emulsion component with the greater amount of barrier is developed by the most active of the developers. This particular procedure will produce a so-called negative color image and if a reversal image is required a few additional steps are necessary.

The complete series of steps, including the time the emulsion is treated in each of these steps and the temperature at which each of them occurs, is listed in the following table:

| Step | Time (sec.) | Temperature °C. |
|---|---|---|
| Prehardener | 180 | 21.1 |
| Neutralizer | 60 | 21.1 |
| Wash | 120 | 18.3 |
| Magenta Developer | 415 | 26.6 |
| Wash | 180 | 18.3 |
| Eliminator I | 15 | 21.1 |
| Wash | 120 | 18.3 |
| Cyan Developer | 540 | 26.6 |
| Wash | 180 | 18.3 |
| Eliminator II | 360 | 26.6 |
| Wash | 180 | 18.3 |
| Yellow Developer | 1420 | 26.6 |
| Wash | 180 | 18.3 |

-continued

| Step | Time (sec.) | Temperature °C. |
|---|---|---|
| Bleach | 120 | 21.1 |
| Wash | 120 | 21.1 |
| Fix | 180 | 21.1 |
| Wash | 240 | 18.3 |
| Dry | 120 | 37.7 |

The various solutions used in these steps set forth above may take the form of the following solutions, it being understood that the formula given are by way of example only and are not to be considered as a limitation.

| Constituent | Amount |
|---|---|
| Prehardener | |
| Water | 1000 ml |
| Kodak SA-1, ρ-toluenesulfonic acid, sodium salt | 0.5 g |
| Sulfuric Acid (18N) | 5.4 ml |
| Kodak HA-1, 2,5-dimethoxytetrahydrofuran | 4.3 ml |
| Sodium Sulfate | 150 g |
| Sodium Bromide | 2.0 g |
| Sodium Acetate | 20.0 g |
| Formalin (37.5% formaldehyde) | 27.0 ml |
| pH | 4.80 |
| Neutralizer | |
| Water | 1000 ml |
| Kodak NA-1, hydroxylamine sulfate | 18.0 g |
| Sodium Bromide | 17.0 g |
| Acetic Acid (Glacial) | 10.0 ml |
| Sodium Sulfate | 50.0 g |
| Sodium Hydroxide | 6.8 g |
| pH | 5.1 |
| Bleach | |
| Water | 1000 ml |
| Sodium Bromide | 43.0 g |
| Potassium Ferricyanide | 165.0 g |
| Borax | 1.0 |
| pH | 8.7 |
| Magenta Developer | |
| Water | 1000 ml |
| Calgon | 8.0 g |
| Sodium Hydroxide | 1.9 g |
| Sodium Sulfite | 5.0 g |
| Sodium Sulfate | 50.0 g |
| Kodak CD-3 4-amino-N—ethyl-N [β-methane sulfonamido ethyl]-m-toluidine sesquisulfate monohydrate | 2.5 g |
| Kodak M-38 1-(2,4,6-trichlorophenyl)-3-ρ-nitroanilino-2-pyrazoline-5-one | 2.25 g |
| Hexylene Glycol | 5.0 ml |
| Disodium Hydrogen Phosphate-7 Hydrate | 20.0 g |
| pH | 10.5 |
| Eliminator I | |
| Sodium Thiosulfate-5 Hydrate | 30.0 g |
| Sodium Sulfite | 150.0 g |
| Water | 1000 ml |
| Eliminator II | |
| Calgon | 8.0 g |
| Sodium Hydroxide | 1.5 g |
| Sodium Sulfite | 5.0 g |
| Sodium Sulfate | 50.0 g |
| Potassium Chloride | 1.0 g |
| Kodak CD-4, 4-amino-3-methyl-N—ethyl-N [β-hydroxyethyl] aniline sulfate | 4.0 g |
| Sodium carbonate | 30.0 g |
| Water | 1000 ml |

-continued

| Constituent | Amount |
|---|---|
| pH | 11.03 |
| Cyan Developer | |
| Water | 1000 ml |
| Calgon | 8.0 g |
| Sodium Hydroxide | 1.8 g |
| Sodium Sulfite | 5.0 g |
| Sodium Sulfate | 50.0 g |
| Potassium Chloride | 1.0 g |
| Potassium Bromide | 2.0 g |
| Kodak CD-4, 4-amine-3-methyl-N—ethyl-N—[β-hydroxyethyl] aniline sulfate | 3.0 g |
| Kodak C-16, N—(o-acetamidophenethyl)-1-hydroxy-2-naphthamide | 2.5 g |
| Hexylene Glycol | 4.0 ml |
| pH | 12.03 |
| Yellow Developer | |
| Water | 1000 ml |
| Calgon | 4.0 g |
| Sodium Hydroxide | 2.0 g |
| Sodium Sulfite | 10.0 g |
| Sodium Sulfate | 30.0 g |
| Potassium Bromide | 2.9 g |
| Kodak C D-6, 4-amino-N—ethyl-N—(2-methoxyethyl)-m-toluidine di-p-toluene sulfonate | 4.5 g |
| Kodak Y55, α-pivaloyl-α-hydroxyphenoxy-2,4-dichloro acetanilide | 2.8 g |
| Hexylene Glycol | 5.0 ml |
| pH | 12.23 |
| Fix | |
| Water | 1000 ml |
| Sodium Thiosulfate-5 Hydrate | 200 g |
| Sodium Sulfite | 5.0 g |
| Sodium Bisulfite | 4.3 g |
| Ethylene diamine tetracetic Acid, Disodium Salt-2 Hydrate | 2.0 g |
| Monosodium Phosphate | 12.7 g |
| pH | 5.5 |

If the mixed grain emulsion is to be used as a reversal print, modifications may be made in the treatment in accordance with known and accepted technology. Thus, if an emulsion is to be treated to provide a reversal image, it will first be treated with an active or strong developer which will overcome all of the antifoggants or barriers incorporated in the various emulsion components and develop each of the components fully. The barriers are not removed by this process but are only overcome so that all of the emulsion components may be developed at once. Thereafter, the component having no barrier therein, is subjected to the corresponding color developer such as, for example, the magenta developer, and thereafter the next emulsion component is developed by the appropriate developer, such as, for example, the cyan developer, and finally, the remaining component is treated by the remaining developer so that all of the color images are developed. The emulsion is then bleached and fixed so that all of the silver and silver halide is removed and the remaining images are only positive color component images, which is the desired goal. It will be understood, of course, that the silver halide remaining after the first black and white development may be fogged in preparation for color development, either by re-exposure to a light or by the use of a fogging agent such as tertiary butylamine borane or other suitable fogging agent.

It is to be understood, of course, that there is no inflexible combination of barriers and sensitized emulsion component. Thus, in the example given, emulsion component no. 1 is sensitized to green light and has no barrier in it. Consequently, it is the emulsion component first developed by the least active developer. Emulsion component no. 2 is red sensitive and has the smaller amount of barrier and thus is developed by the developer of medium activity. In the example given, the second developer will produce a cyan image which properly corresponds to the red sensitivity of the corresponding emulsion component.

The third component, having the greatest amount of barrier, is not provided with any special sensitizing material and is sensitive substantially solely to blue light and the component is developed by the most active developer which produces a yellow image that corresponds to the blue sensitivity of the emulsion. If desired, the magenta image could be formed in an emulsion component having the maximum amount of barrier, the yellow image formed in the emulsion component having the lesser amount of barrier, and the cyan image formed in the component having no barrier. This would, of course, require a different sequence of treatment steps but it will be appreciated that the emulsion process is sufficiently flexible so that any desired result can be obtained.

It will be realized that one of the basic concepts of the invention is that of separating the individual components, one from another, by means of the inclusion of the barriers or antifoggants. Others have made use of barriers for somewhat similar purposes but not to the extent of providing a three-color mixed grain single emulsion. Of course, it is also important that the sensitizing dyes incorporated in the separate components not wander from one component to the other, for this would degrade the images. If the emulsion components are properly compounded, such as in the manner set forth herein, substantially no wandering of the sensitizing dyes occurs and clear, colorful images are secured.

While a preferred form of preparing the mixed grain emulsion and a preferred method of processing that emulsion have been disclosed, it is to be understood that the invention is not to be limited to the particular combination of chemicals nor the particular sequence of steps herein described except as limited by the following claims.

I claim:

1. A mixed grain photographic emulsion capable of simultaneous exposure in all spectral regions and for use with chemical photographic developers, said emulsion containing metallic silver and silver ions and comprising:

a first emulsion component sensitive to the wavelength, intensity or color of light;

a second emulsion component having a sensitivity to the wavelength, intensity or color of light that is different from said sensitivity to the first emulsion component;

a third emulsion component having a sensitivity to the wavelength, intensity or color of light that is different from said sensitivity of the first and second emulsion components;

an antifoggant in at least two of said emulsion components to provide different levels of antifoggant activity in each emulsion component, said antifoggant comprised of molecules having a portion which is hydrophillic as to metallic silver and silver ions and a portion which is hydrophobic as to said developers, whereby said antifoggant molecules are adsorbed on said metallic silver and silver ions by said hydrophillic portion, and the action of the developers on the metallic silver and silver ions is separately and sequentially inhibited by said hydrophobic portion, thereby permitting each emulsion component to be developed separately and sequentially by said developers.

2. An emulsion as defined in claim 1 in which said first emulsion component is sensitive to light of a first spectral range, said second emulsion component is sensitive to light of a spectral range different from said first spectral range, and said third emulsion component sensitive to light of a third spectral range different from said first and second spectral ranges.

3. An emulsion as defined in claim 2 in which said spectral ranges combine to cover the major portion of the visible spectrum.

* * * * *

UNITED STATES PATENT AND TRADEMARK OFFICE

CERTIFICATE OF CORRECTION

PATENT NO. : 4,351,898

DATED : Sep. 28, 1982

INVENTOR(S) : GOLDBERG, RICHARD J.

It is certified that error appears in the above-identified patent and that said Letters Patent is hereby corrected as shown below:

Column 5, lines 25-26, the chemical formula of green sensitizing dye, that portion of the formula reading "-napthoxazolylidene) ethylidene]" should read ---napthoxazolylidene)-ethylidene] --.

Column 6, line 32, "minimial" should read -- minimal --.

Column 8, line 12, the Cyan Developer formula, that portion of the formula reading "4-amine-" should read -- 4-amino- --.

Signed and Sealed this

First Day of March 1983

[SEAL]

*Attest:*

GERALD J. MOSSINGHOFF

*Attesting Officer*

*Commissioner of Patents and Trademarks*